US006644073B1

(12) United States Patent
Gartside et al.

(10) Patent No.: US 6,644,073 B1
(45) Date of Patent: Nov. 11, 2003

(54) CONTAINERS

(76) Inventors: Victor Gartside, The Old Sawmill, Ripley, North Yorkshire HG3 3 AY (GB); Trevor Harry Hodgson, The Adelphi Hotel 1 Hunslet Road, Leeds LS10 1JQ, West Yorkshire (GB)

( * ) Notice: Subject to any disclaimer, the term of this patent is extended or adjusted under 35 U.S.C. 154(b) by 0 days.

(21) Appl. No.: 09/936,754

(22) PCT Filed: Mar. 21, 2000

(86) PCT No.: PCT/GB00/01056

§ 371 (c)(1),
(2), (4) Date: Sep. 17, 2001

(87) PCT Pub. No.: WO00/56180

PCT Pub. Date: Sep. 28, 2000

(30) Foreign Application Priority Data

Mar. 23, 1999 (GB) ..... 9906516
Nov. 3, 1999 (GB) ..... 9925913

(51) Int. Cl.[7] ..... B65D 55/14; E05C 19/06

(52) U.S. Cl. ..... 70/169; 70/173; 109/52; 248/222.11; 292/86

(58) Field of Search ..... 70/169, 173; 109/52; 292/80, 81, 86, 87; 248/222.11, 222.13, 222.52, 553

(56) References Cited

U.S. PATENT DOCUMENTS

| | | | | |
|---|---|---|---|---|
| 684,018 | A | * 10/1901 | Wellman | |
| 1,395,627 | A | * 11/1921 | Binkley | |
| 1,398,094 | A | * 11/1921 | Duncan et al. | |
| 1,531,953 | A | * 3/1925 | Kendall | |
| 1,935,626 | A | * 11/1933 | Evans | |
| 2,809,766 | A | * 10/1957 | Anderson | |
| 3,175,853 | A | * 3/1965 | Gilbertson | |
| 3,908,942 | A | * 9/1975 | Keith et al. | 70/58 X |
| 4,051,790 | A | * 10/1977 | Meditz et al. | 109/58 |
| 4,964,661 | A | * 10/1990 | Cadwell et al. | 292/87 |
| 5,480,068 | A | * 1/1996 | Frazier et al. | 222/153.03 |
| 5,542,438 | A | * 8/1996 | Adams et al. | 131/238 |
| 5,743,606 | A | * 4/1998 | Scholder | 312/223.2 |

FOREIGN PATENT DOCUMENTS

| | | | |
|---|---|---|---|
| DE | 2133770 | * 1/1973 | |
| FR | 2591439 | * 6/1987 | |
| IT | 268730 | * 10/1929 | 292/86 |

* cited by examiner

*Primary Examiner*—Lloyd A. Gall
(74) *Attorney, Agent, or Firm*—Klauber & Jackson

(57) ABSTRACT

The invention discloses a container, usable as an ash-tray and/or as a food container, comprising first and second members removable secured together. The second member can be permanently or removably secured to a supporting surface. The first and second members are secured together by a locking device.

5 Claims, 2 Drawing Sheets

CONTAINERS

This invention relates to containers, and more particularly, although not exclusively, to ash-trays.

In many instances, and of note in public houses and other drinking establishments, and particularly where such public houses and establishments have outside facilities such as, for example, a 'beer garden', ash-trays are very often stolen and removed, or they are accidentally broken, which is very costly in terms of replacement, and the invention seeks to provide a container which will overcome these problems and which will also have other uses.

According to the present invention there is provided a container comprising an upper first member and a lower second member, said first and second members being removably securable together, said lower second member having means to enable it to be permanently or removably secured to a supporting surface.

Said first member will preferably include a downwardly depending skirt portion which, when the two members are secured together, envelops said second member.

In a first embodiment of the invention, the first and second members will be removably secured together by a locking device carried by said first member, said locking device including means adapted to engage said second member.

Said locking device will preferably be operable by a key passing through a wall of said first member.

Said locking member will preferably be located in an annular void of said first member, and will preferably include a flexible arm secured to an inner wall of said first member.

The means adapted to engage said second member will preferably comprise a stud or projection provided on said arm, said stud or projection passing through said inner wall and being adapted to engage a recess or blind bore in a wall of said second member.

In an alternative embodiment of the invention, the lower member will incorporate a female thread portion and said upper member a male thread portion, such that said members may be screwed into engagement so as to form a composite unit.

The upper and lower members will preferably be dish-shaped, an internal wall of the lower member having the female thread, the male thread on the upper member being provided on a boss depending from the base of said upper member.

In order that the invention may be more readily understood, embodiments thereof will now be described, by way of example, reference being made to the accompanying drawings, wherein.

Figure 1:
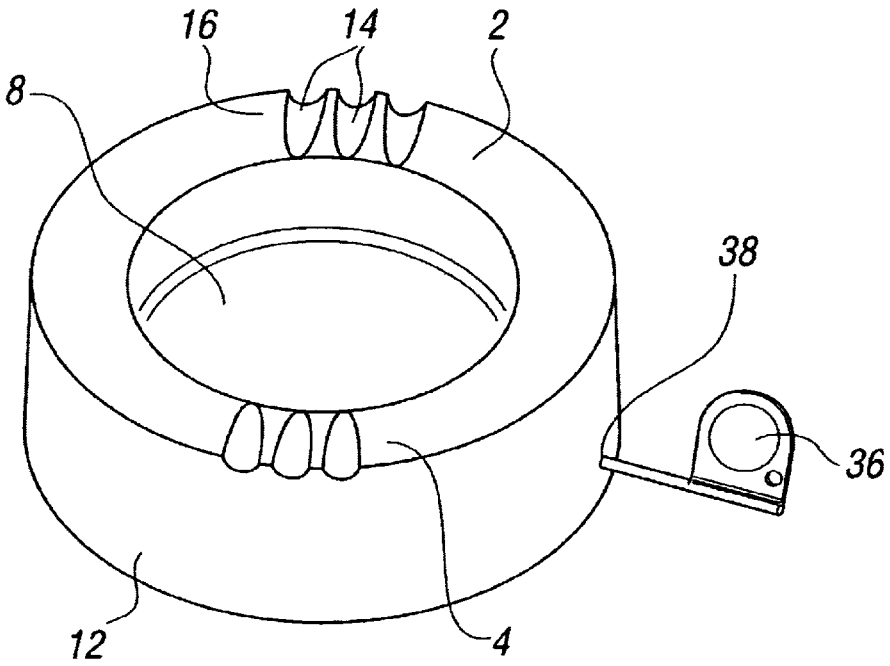
FIG. 1 is a top perspective view of a container according to a first embodiment of the invention.
Figure 2:
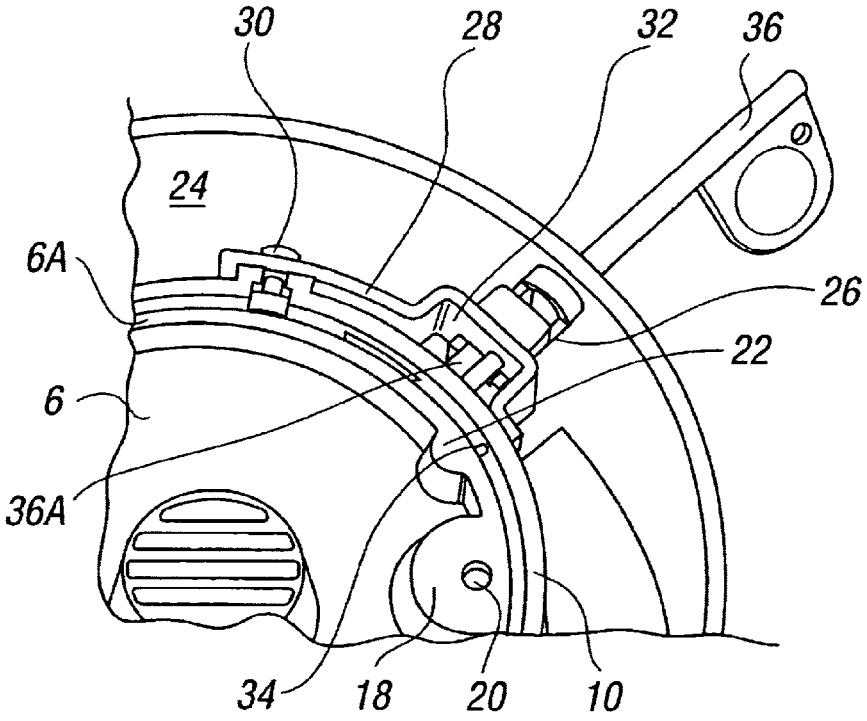
FIG. 2 is an underneath perspective view, partly cut away, of part of the container of FIG. 1.

Referring to the drawings and firstly to FIGS. 1 and 2, a container in the form of an ash-tray, indicated generally by reference numeral 2, comprises a first upper dished member 4 and a second, lower member 6. The upper member 4 has a recess 8 and spaced inner and outer walls 10 and 12. Grooves 14 are provided in the rim 16 of the upper member in which cigarettes or cigars may be placed. The members 4 and 6 are removable secured together.

The lower member 6, in the assembled state of the ash-tray, lies wholly within and is enveloped by the upper member 4, such that the lower member 6 is not visible when the ash-tray is on a supporting surface (not shown)—see FIG. 1.

The lower member 6 is provided with a first plurality of bosses or lugs, one of which is shown at 18, each boss or lug having a through-bore 20 through which may be passed a screw or other fastening device (not shown) to secure said lower member to a supporting surface. Preferably, there will be two such bosses or lugs 18 located at diametrically opposed positions of said lower member.

The lower member 6 is also provided with a second plurality, preferably four, of bosses or lugs, one of which is indicated by reference numeral 22, each of said bosses or lugs having a recess or blind bore therein, said recess or blind bore being substantially normal to the wall 6A of the lower member 6.

The upper and lower members 4 and 6 are preferably composed of plastics material, although other material(s) may be used if desired.

Secured to the inner wall 10 of the upper member 4—and located in the annular void 24 of the upper member—is a locking mechanism indicated generally by reference numeral 26. The locking mechanism comprises an arm 28 which is secured to the inner wall 10 of the member 4 by means of a pin or other member 30, the arm 28 including a recessed portion 32. At the end remote from the pin or other member 30, the arm 28 is provided with a stud or projection 34 which is adapted to engage in any one of the recesses or blind bores in the bosses or lugs 22, as will be hereinafter explained. The locking mechanism is adapted to be operated by means of a key 36 which can pass through a suitable key-hole 38 in the outer wall of the upper member 4 and through a suitable aperture (not shown) in the arm 28.

The arm 28 is preferably composed of a flexible plastics material. although other flexible materials may be used if preferred.

To assemble the ash-tray—assuming here that the upper and lower members 4 and 6 are separated one from the other—and to secure the ash-tray to a supporting surface, the lower member 6 is firstly secured to said supporting surface by passing screws or other fastening means through the through-bores 20 in the bosses or lugs 18. To then secure the upper member 4 to the lower member 6, the key 36 is inserted into the locking mechanism 26—by passing the key through the outer wall 12 and the aperture in the arm 28—whereafter the key is rotated such that the head 36A of the key engages the underside of the recessed portion 32. The key is then moved outwardly such that the head 36A of the key 36 causes the arm 28 to flex about the pin or other member 30 to a 'raised' position and thus cause the stud or projection 34 to move relative to the inner wall 10 of the member 4.

With the arm 28 in the 'raised' position as described above, the upper member 4 is then placed over the lower member 6—such that the lower member lies wholly within the confines of and is enveloped by the upper member 4—whereafter the key may be rotated and withdrawn so as to allow the arm 28 to move back towards its normal position. In such position of the arm 28, the stud or projection 34 will (in all probability) be in engagement with the wall 6A of the lower member 6, and to secure the upper member to the lower member it is a simple matter of rotating the upper member relative to the lower member until the stud or projection 34 engages in one of the recesses or blind bores in the bosses or lugs 22. When the stud or projection 34 so engages, the arm 28 will return to its normal position as shown in FIG. 2.

Thus the upper member 4 is fully and firmly secured to the lower member 6, the whole being secured to the supporting surface as referred to above, and the upper member cannot be removed other than by use of the key.

To release the upper member 4 from the lower member 6—leaving the lower member 6 in situ on the supporting surface—it is necessary only to insert and rotate the key 36 and then to lift the arm 28 so as to release the stud or projection 34 from the recess or blind bore. The upper member may then be lifted from the lower member.

Instead of using screws or other fastening means to secure the lower member 6 to a supporting surface, it will be appreciated that the lower member may be provided with one or more adhesive pads, whereby the lower member may be stuck to the supporting surface.

Figure 3:
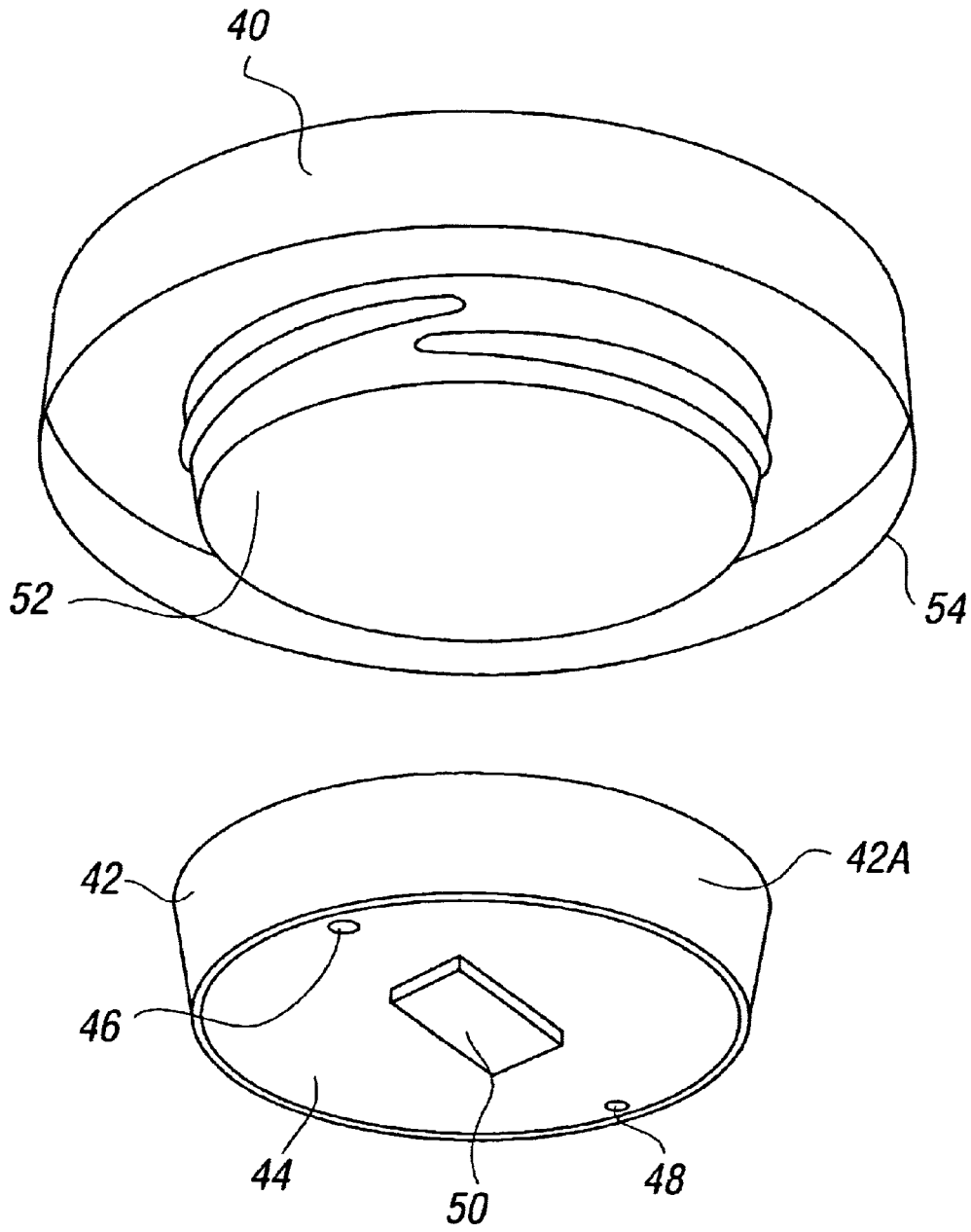
FIG. 3 is an underneath exploded perspective view of a container according to an alternative embodiment of the invention.

Referring now to FIG. 3, the container illustrated comprises an upper member 40 and a lower member 42, both of which are preferably composed of plastics material.

The lower member 42 is dish-shaped and, although not seen in the drawing, the inner surface of the wall 42A of the lower member 42 has a screw-thread. The base 44 of the member 42 has through-holes 46 and 48 therein, and is provided with an adhesive pad 50.

The upper member 40, whose upper surface is recessed such that the member is dish-shaped, has a threaded boss 52 which depends from the base of the member and which is for engagement with the threaded wall 42A of the lower member 42. The wall of the member 40 extends downwardly to form a skirt 54 which, when the members are interengaged to form the composite unit, envelops the lower member 42 such that the lower member is obscured and virtually or totally invisible.

In use, the lower member 42 is secured to a supporting surface (not shown)—either by means of the adhesive pad 50 or by passing screws (not shown) through the through-holes 46 and 48, or both—whereafter the upper member 40 is screwed to the lower member 42 so as to form the composite unit.

In its use as an ash-tray, when the unit needs emptying, it is merely necessary to unscrew the upper member from the fixed lower member 42, discard the contents, and then re-affix the member 40 to the member 42.

In circumstances where the upper member 40 'disappears', the lower member itself may be used as an ash-tray, although it would be less convenient to remove this from the supporting surface for emptying and/or cleaning purposes.

Instead of the upper member 40 being composed of plastics material, it may be formed of relatively cheap foil or other similar material such that it is disposable and easily and cheaply replaced by a substitute unit.

In addition, instead of the members 40 and 42 being interengaged by means of the afore-mentioned screw-threads, other means may be provided to secure the two members together. For example, a bayonet fitting may be used, or indeed other suitable means may be provided. Also, if desired or preferred, locking means may be provided between the upper and lower members 40 and 42 in order to prevent unauthorised removal of the member 40 and/or the inadvertent displacement of the member 40.

Thus the invention provides a container which is securable so as to prevent theft and/or accidental displacement, but which enables an upper portion of the container to be quickly and easily removed for emptying and perhaps other reasons.

Whilst the above description has been specifically related to ash-trays, it is appreciated that containers according to the invention will have other uses. For example, the containers may well be used for infants and children, and also perhaps for the elderly and infirm, where a degree of stability of a food container may be desirable for one reason or another. In addition, containers according to the invention will be usable in the feeding of animals, particularly domestic pets, where it is required that the container be prevented from moving about whilst the animal is feeding.

Finally, containers according to the invention will be beneficial perhaps in mobile homes, and also in water-going or sea-going , craft where meals are often taken whilst the craft is moving over the water.

What is claimed is:

1. A container comprising an upper first member and a lower second member, said first and second members being removably securable together, said lower second member having means to enable it to be permanently or removably secured to a supporting surface, said first member including a downwardly depending peripheral skirt portion which, when the first and second members are secured together, envelops said second member, said first and second members being removably secured together by a locking device carried by said first member, said locking device including means to engage said second member, said locking device being located in an annular void of said first member and includes a flexible arm secured to an inner wall of said first member.

2. A container according to claim 1, wherein said locking device is operable by a key passing through a wall of said first member.

3. A container according to claim 1, wherein the means adapted to engage said second member comprises a stud or projection provided on said arm, said stud or projection passing through said inner wall and being adapted to engage a recess or blind bore in a wall of said second member.

4. A container according to claim 1, wherein said second member is secured to a supporting surface by means of screws or other fastening means and/or by one or more adhesive pads.

5. A container according to claim 1, wherein said first and second members are composed of plastics materials.

* * * * *